US005427436A

United States Patent [19]

Lloyd

[11] Patent Number: 5,427,436

[45] Date of Patent: Jun. 27, 1995

[54] ADJUSTABLE HEADREST

[76] Inventor: John T. Lloyd, 80926 Turkey Run Rd., Creswell, Oreg. 97426

[21] Appl. No.: 249,902

[22] Filed: May 26, 1994

[51] Int. Cl.[6] ..... A47C 7/00; A47C 7/36; A47C 7/38

[52] U.S. Cl. ..... 297/408; 297/409; 5/622; 5/634

[58] Field of Search ..... 297/408, 373, 363, 365, 297/409; 5/622, 634; 248/284, 286, 118

[56] References Cited

U.S. PATENT DOCUMENTS

| | | | |
|---|---|---|---|
| 1,009,417 | 11/1911 | John . | |
| 1,629,306 | 5/1927 | Reeder . | |
| 1,728,025 | 9/1929 | Weber . | |
| 2,461,434 | 2/1949 | Moyers . | |
| 2,463,410 | 3/1949 | Morris . | |
| 2,568,417 | 2/1952 | Cole . | |
| 2,661,050 | 12/1952 | Felter . | |
| 3,477,761 | 11/1969 | Krantz . | |
| 3,572,835 | 3/1971 | Kees, Jr. . | |
| 3,603,642 | 9/1971 | Laekaker . | |
| 3,761,128 | 9/1973 | Schenk et al. . | |
| 3,858,937 | 1/1975 | Norris . | |
| 4,139,093 | 2/1979 | Holmes . | |
| 4,779,297 | 10/1988 | Sturges . | |
| 5,127,823 | 1/1993 | Riach | 297/408 |
| 5,177,823 | 1/1993 | Riach . | |
| 5,233,713 | 8/1993 | Murphy et al. . | |
| 5,276,927 | 1/1994 | Day . | |
| 5,347,668 | 9/1994 | Manning | 5/622 X |

FOREIGN PATENT DOCUMENTS

| | | | |
|---|---|---|---|
| 0510360 | 1/1955 | Italy | 297/373 |
| 0935969 | 9/1963 | United Kingdom | 297/373 |
| 2161702 | 1/1986 | United Kingdom . | |

*Primary Examiner*—Peter R. Brown
*Assistant Examiner*—Anthony Barfield
*Attorney, Agent, or Firm*—Kolisch, Hartwell, Dickinson, McCormack & Heuser

[57] ABSTRACT

An adjustable headrest includes a base supporting a crescent-shaped pad. The bottom side of the base is equipped with two triangular support structures, each of which includes a long arm and a short arm pivotally attached to distal and proximal junction structures, respectively, on the bottom side of the base. The other end of the arms are commonly and pivotally connected to a horizontal rod, one end of which is equipped with a cam lever capable of jointly controlling the lock and release status of two clamps, each of which is associated with one of the support structures. In each triangular support structure, one of the arms has an adjustable effective length. The cam lever is movable between a lock-position and a release-position. When the lever is in the lock position, the clamp prevents all rotational movement of both rectangular support structures about the horizontal rod, and prevents any adjustment of the effective length of the arms. The headrest support assembly allows height and angle adjustment of the headrest relative to a stationary table or chair by manipulating only a single clamp.

11 Claims, 5 Drawing Sheets

ADJUSTABLE HEADREST

FIELD OF THE INVENTION

The present invention relates generally to headrests. In particular, the invention involves a headrest support assembly which allows adjustment around at least two axes, relative to a stationary table or chair, by manipulating a single clamp.

BACKGROUND OF THE INVENTION

Headrests are commonly used on tables and chairs. Vehicle seats, dentist chairs, operating and massage tables are just a few examples of the many devices which are designed to permit adjustable orientation of a head-support structure relative to a table or chair.

There are many reasons why it is desirable to be able to adjust the position of a headrest structure relative to an associated body-supporting structure. Depending upon the physical size and shape of the user, as well as possibly the type of procedure being performed, it is often necessary to adjust both the angle as well as the height of the headrest relative to the table or chair. For this reason, many designers in the field have attempted to provide a dual-axis pivoting headrest.

Examples of such devices are disclosed in the following U.S. Pat. Nos. 5,177,823 to Riach, 3,477,761 to Krantz, 5,276,927 to Day, 5,233,713 to Murphy et al. and 3,761,128 to Schenk et al. There are at least two principal disadvantages, however, with dual-axis pivoting headrests in the prior art. First, they usually require manipulation of multiple clamps or switching mechanisms in order to adjust the headrest around plural axes. Second, coupling between the headrest and the table or chairs is typically accomplished with a single pair of coupling elements spanning between two axes of rotation, thus providing a limited amount of strength and support for the headrest structure.

It is an objective of the present invention to provide an adjustable headrest assembly which is capable of pivoting around at least two axes, whereby all adjustment is alternately locked and unlocked by manipulating a single clamp.

Another important objective of the invention is to provide an adjustable headrest support system which employs a reinforced coupling assembly between the headrest and the chair or table, thus providing a sturdier, more supportive headrest.

SUMMARY OF THE INVENTION

The objectives stated above as well as other important objectives are achieved with the adjustable headrest assembly of the present invention. The headrest includes a base which has a top side and a bottom side and an imaginary vertical plane perpendicularly bisecting the base into two lateral portions. A proximal junction structure and a distal junction structure are secured near the bottom side of the base. A short arm has a first end and second end. The proximal junction structure is pivotally connected to the short arm near its first end. A long arm has a first end and a second end. The distal junction structure is pivotally connected to the long arm near its first end. A rod, perpendicularly oriented relative to the plane, forms an axis of rotation and point of pivotal connection between the short and long arms near their second ends. A triangular support structure is defined by the two arms and the portion of the base which extends between the two junction structures.

Each of the arms have an effective length relative to the triangular support structure. At least one of the arms' effective length is adjustable. A clamp is associated with the rod and is capable of alternately locking and releasing all pivotal orientation and effective length adjustment of the arms relative to the rod.

In a preferred embodiment, a second triangular support structure like the first triangular support structure is used. Each lateral portion of the base has one of the triangular support structures attached to its bottom side. A pair of posts are also connected to the rod and function for anchoring the headrest to a table or chair. A pair of stationary discs, each of which is fixedly attached to one of the posts and has a serrated face around a hole through which the rod passes, so that when the posts are anchored to a chair or table, orientation of the serrated face remains rotationally stationary irrespective of base movement. Each of a pair of rotating discs is fixedly attached to one of the triangular support structures and has a serrated face juxtaposed with the serrated face of the corresponding stationary disc, and a central hole through which the rod passes. The clamp includes a cam lever movable between a lock-position and a release-position, so that when the cam lever is moved to the lock-position, the serrated face of each stationary disc is forced to engage the serrated face of the corresponding rotating disc, thereby locking all movement of the triangular support structure relative to the rod and posts.

DETAILED DESCRIPTION OF THE INVENTION

Figure 1A:
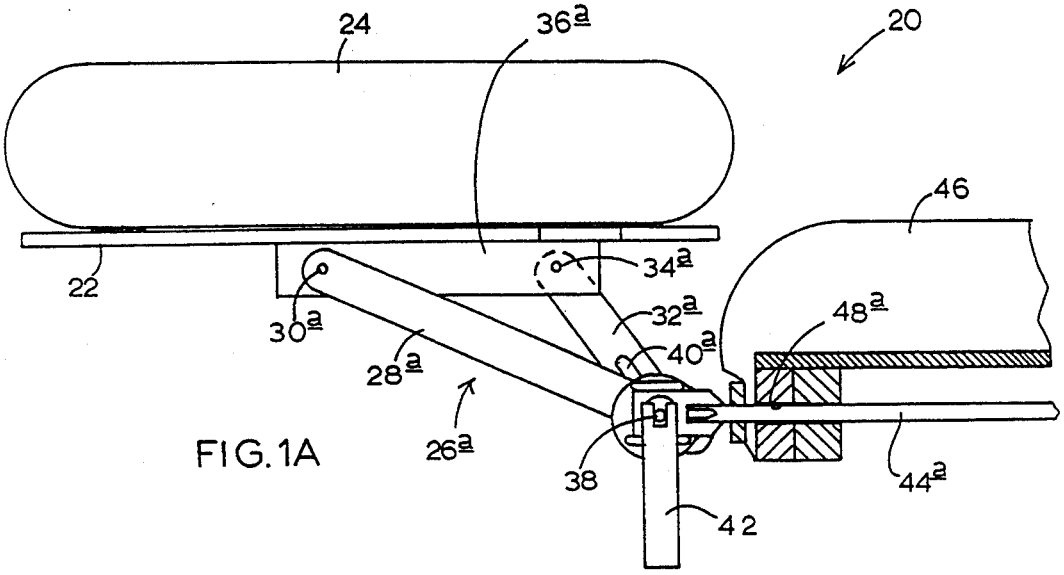
FIGS. 1A, 1B and 1C are a series of side views of a headrest installed in a table, according to a preferred embodiment of the present invention. The series of figures illustrate modified orientations of the headrest relative to the table.
Figure 1B:
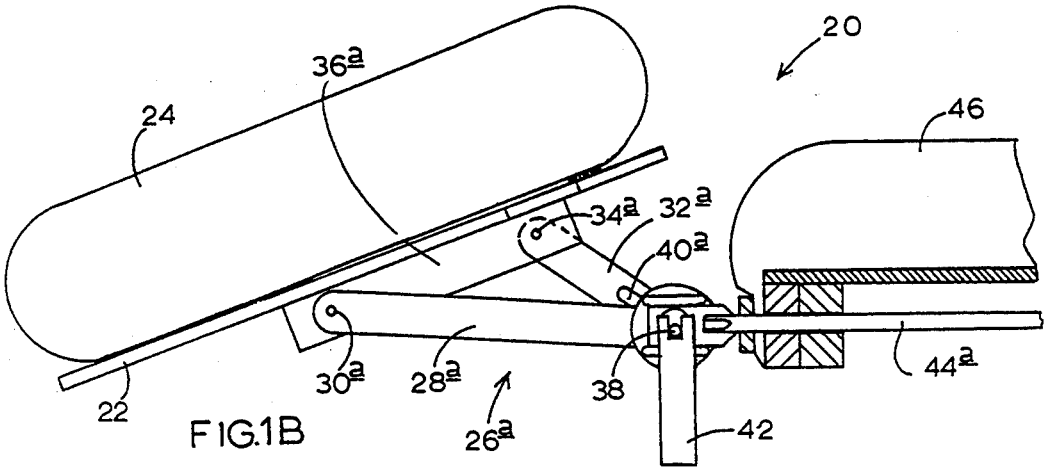
Figure 1C:
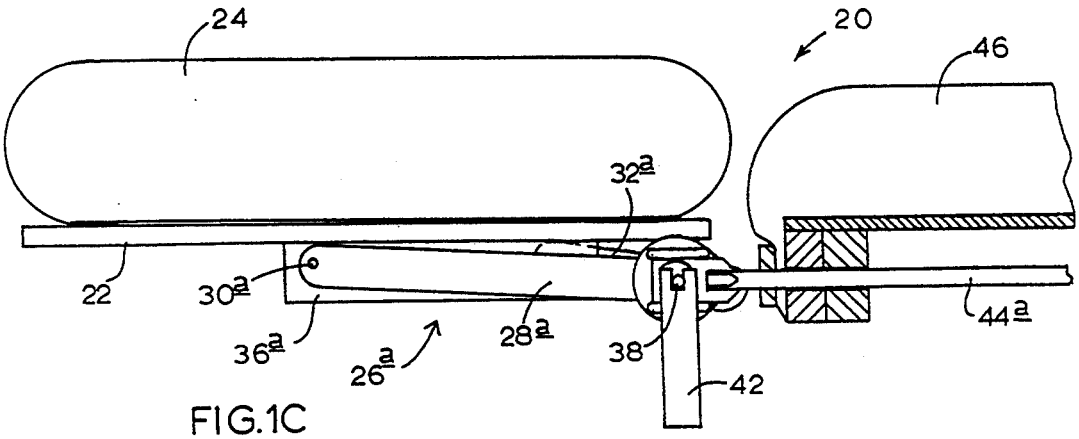

FIGS. 1A, 1B and 1C illustrate a headrest, in accordance with a preferred embodiment of the present invention, in three different levels and angular orientations relative to a massage table.

In FIG. 1A, the headrest 20 includes a base plate 22 which supports a pad or cushion 24. It is not necessary for the base to be in a plate form. A satisfactory "base" may take many different forms, i.e., practically any rigid frame structure which is capable of supporting a person's head. The base plate 22 is supported on its bottom side by a triangular support structure 26*a*, also referred to as an arm assembly. The arm assembly 26*a* consists of a long arm 28*a* pivotally connected to a distal junction 30*a*, and a short arm 32*a* pivotally connected to a proximal junction 34*a*. The distal and proximal junctions 30*a* and 34*a* are preferably along a line approximately parallel to the plane of the paper which the figure is drawn on. The proximal and distal junctions should be positioned in a fixed orientation near and relative to the bottom side of base plate 22. As shown in FIG. 1A, the distal and proximal junctions are defined by holes in an elongated flange 36*a* attached to the bottom side of base plate 22. Arms 28*a* and 32*a* are commonly and pivotally attached to a horizontal rod 38. Each of arms 28*a* and 32*a* have an effective length relative to the triangle formed by the two arms and the portion of the base plate between the junctions. At least one of the arms, for example, short arm 32*a* in FIG. 1A, has a slot 40*a* through which rod 38 passes. A clamp, operated by cam lever 42 is manipulable between a lock-position and a release-position. When the clamp is in the release-position, the arms are free to pivot around rod 38, and the effective length of short arm 32*a* is adjustable by moving slot 40*a* relative to rod 38. When cam lever 42 is moved so as to set the clamp in its lock-position, all pivotal movement of arms 28*a* and 32*a* about rod 38, and effective length adjustment of short arm 32*a*, is prevented.

Pivoting movement of the arms around rod 38 is alternately prevented then allowed by, respectively, engaging then disengaging corresponding serrated faces on opposing discs. The disc structures will be described in more detail below. In contrast, adjustment of the effective length of short arm 32*a* is controlled by alternating between two degrees of friction applied to arm 32*a* in the vicinity of slot 40*a*. When the clamp is in the lock-position, as more clearly illustrated in FIG. 2, short arms 32*a* and 32*b* are frictionally sandwiched between washers, thereby preventing effective length adjustment of the short arm. When the clamp is in the release-position, the degree of friction exerted on the short arms by their respective pairs of washers, is lessened to an appropriate degree so that adjustment of the effective lengths of the short arms is permitted, however, a small degree of residual friction remains so that the headrest does not "flop". In other words, even when the clamp is in the release-position, the geometry or the triangular support structure will not change unless manual pressure is exerted on the headrest by the user.

A post 44*a* is also connected to rod 38 and is free to pivot relative to rod 38 when the clamp is in the release-position. Table 46 has a hole 48*a* through which post 44*a* can be inserted, thereby securely attaching the headrest 20 to the table 46.

FIGS. 1B and 1C show the same parts as FIG. 1A, however, the relative positions of the parts have been altered in order to illustrate the adjustability of headrest 20. In FIG. 1A base plate 22 and pad 24 of headrest 20 are elevated and substantially parallel to table 46. In FIG. 1B the average height of headrest 20 is approximately the same as table 46, however, the angle of headrest 20 has been adjusted substantially. The geometry of triangular support structure 26*a* in FIGS. 1A and 1B is substantially unchanged, however, the orientation of triangular support structure 26*a* relative to table 46 has been rotated around rod 38. It is also apparent in FIGS. 1A, 1B and 1C that the height and angular orientation of headrest 20 directly tracks the orientation of a line including the proximal junction 34*a* and the distal junction 30*a*. FIG. 1C shows the orientation of headrest 20 when triangular support structure 26*a* is essentially collapsed. This allows headrest 20 to be placed in a substantially level and parallel orientation relative to table 46.

FIGS. 1A, 1B and 1C illustrate an important structural feature of the invention, namely, the reinforced coupling arrangement of long arm 28*a* and short arm 32*a* between table 46 and headrest 20. By cooperatively employing two coupling arms in connection with proximal and distal junctions, respectively, particularly when tandem triangular support structures are used under opposing lateral portions of the headrest, a greater degree of strength and sturdiness of the headrest relative to the table is achieved in comparison to prior headrests.

Figure 2:
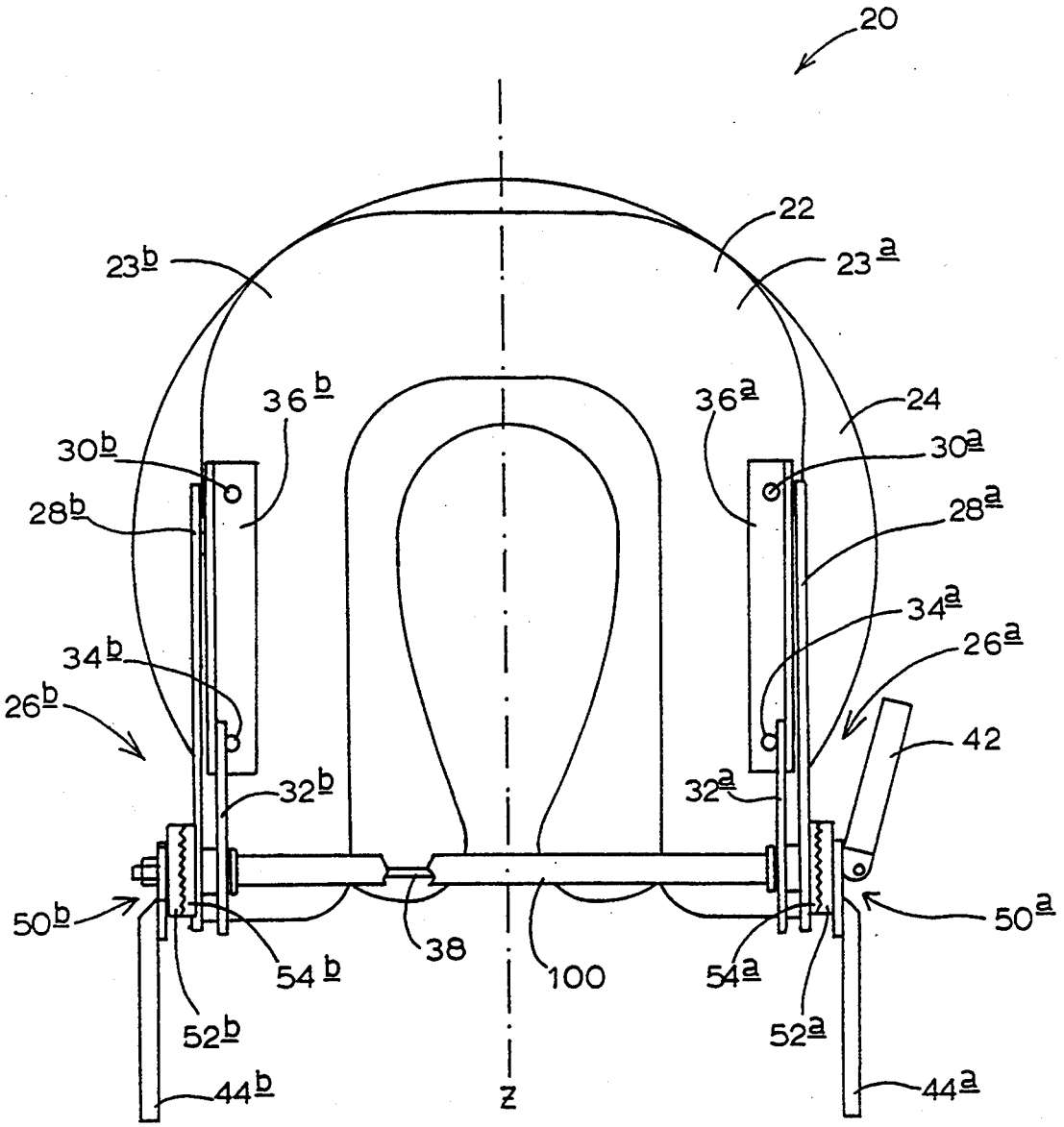
FIG. 2 is a bottom view of the headrest shown in FIGS. 1A, 1B and 1C.

FIG. 2 shows a view or the bottom side of headrest 20. For explanatory purposes, an imaginary vertical plane of symmetry Z, is perpendicular to the paper on which FIG. 2 is drawn, and perpendicularly bisects the platform 22 into two lateral portions 23*a* and 23*b*.

A preferred embodiment of the invention, as shown in FIG. 2, includes two triangular support structures 26*a* and 26*b*. Each of the lateral portions 23*a* and 23*b* of base plate 22 have a triangular support structure fixedly attached to its bottom side. Triangular support structures 26*a* and 26*b* are practically the same. For the purpose of referring to elements of triangular support structure 26*b*, the same numbers as those used in reference to triangular support structure 26*a* are used, except that they are modified with the letter "b". Unless otherwise indicated, everything discussed and illustrated in the application relative to one of the triangular support structures, applies to both triangular support structures.

Each triangular support structure has a clamp 50*a* or 50*b*, both of which are engaged and disengaged concertedly between lock-positions and release-positions, respectively, by movement of cam lever 42. Clamp 50*a* includes two discs 52*a* and 54*a* with serrated faces juxtaposed with each other. The rotational position of disc 52*a* relative to rod 38 (which is mostly hidden from view by sleeve 100 in FIG. 2) is at all times linked with the orientation of post 44*a*. The rotational position of disc 54*a* relative to rod 38 is at all times linked to the rotational position of triangular support structure 26*a*, so that when cam lever 42 is in the release-position, triangular support structure 26*a*may freely rotate relative to post 44*a*. However, when cam lever 42 is moved to the lock-position, the serrated faces of discs 52*a* and 54*a* engage, thereby preventing relative movement between the angular orientation of triangular support structure 26*a* and post 44*a*. All of the discussion concerning clamp 26*a* is equally descriptive of clamp 26*b*.

Sleeve 100 functions to conceal rod 38. More importantly, sleeve 100 is an important structural element of the clamping system because it allows the force applied by cam lever 42 to be transferred to clamp structure 50*b*, thereby causing engagement of both sets of discs, i.e., locking both clamps.

Figure 3:
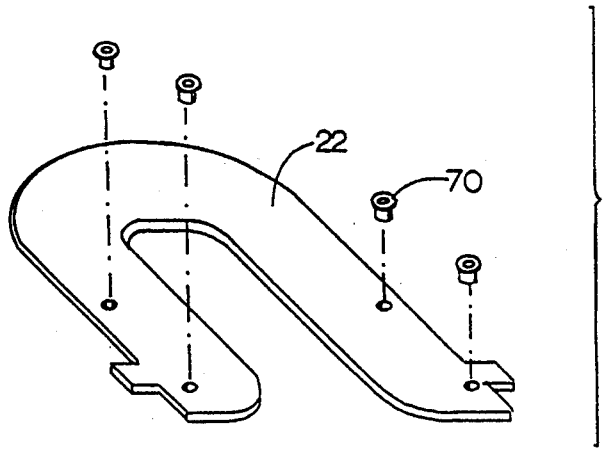
FIG. 3 is a perspective view of the top side of a headrest base.

FIG. 3 shows the top side of base plate 22 before attaching triangular support structures 26*a* and 26*b* to the other side of base plate 22. Propel nuts 70 are placed through holes in the top side of base plate 22 for receiving screws which will attach triangular support structures 26*a* and 26*b* to the bottom side of base plate 22.

Figure 4:
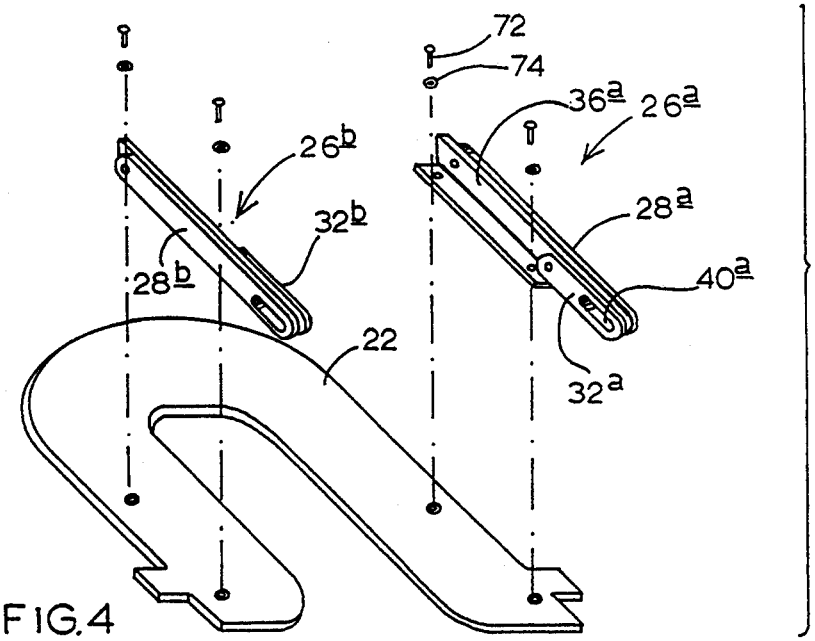
FIG. 4 is a perspective view illustrating the assembly of arm supports to the bottom side of a headrest base.

FIG. 4 illustrates the step of attaching triangular support structures 26*a* and 26*b* to the bottom side of U-shaped base plate 22. The triangular support structures, or arm assemblies 26*a* and 26*b* are each typically supplied as three principal parts, namely short arm 32*a* and long arm 28*a* attached to proximal and distal junctions, respectively, along a cross-bar or flange member 36*a*. Screws 72 are inserted through washers 74 into propel nuts 70, thus securing triangular support structures 26*a* and 26*b* to the bottom side of base plate 22.

Figure 5:
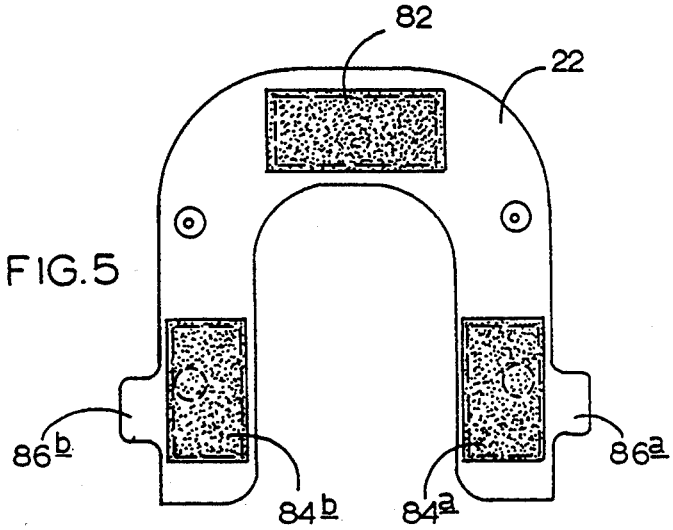
FIG. 5 is a top view of a headrest base.

As shown in FIG. 5, on the top side of base plate 22, velcro patches 82, 84*a* and 84*b* are secured in positions corresponding to velcro pads 66 on the bottom side of pad 60, so that pad 60 can be easily attached and removed from base plate 22. Handles 86*a* and 86*b* permit the user to move base plate 22 relative to table 46 when the clamp is in the release-position.

Figure 6:
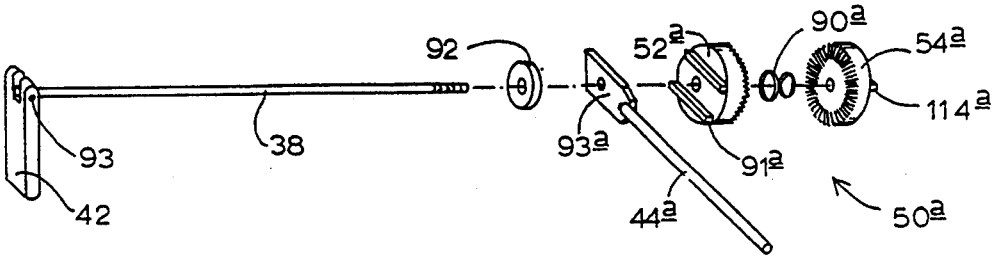
FIG. 6 is a partial exploded perspective view of a clamp structure employed in a preferred headrest embodiment of the present invention.

FIG. 6 is an exploded view of clamp 50*a*. Cam lever 42 is attached to one end of rod 38 which passes through, in series, washer 92, post 44*a*, stationary disc 52*a*, tapered coil spring 90*a*, and rotating disc 54*a*. It can be seen in FIG. 6 that the non-serrated face of stationary disc 52*a* has a pair of guide ridges 91*a* for flanking a rectangular portion 93 of post 44*a*, thereby effectively locking the rotational position of stationary disc 52*a* to the rotational position of post 44*a*. Also shown in FIG. 6 is pivot pin 93 which secures cam lever 42 on to rod 38, and serves as an axis of rotation for the lever.

Tapered coil spring 90*a* serves the important function of forcing discs 52*a* and 54*b* apart when the clamp is in the release-position. The tapered structure of the spring is advantageous because, when compressed, the spring has a minimum height, i.e., the thickness of one coil. Alternatively, it would also be possible to use another type of spring, for example, a straight coiled spring or a leaf spring, provided the region where the spring is seated is contoured so as to allow full engagement of the serrated teeth when the spring is fully compressed.

Figure 7:
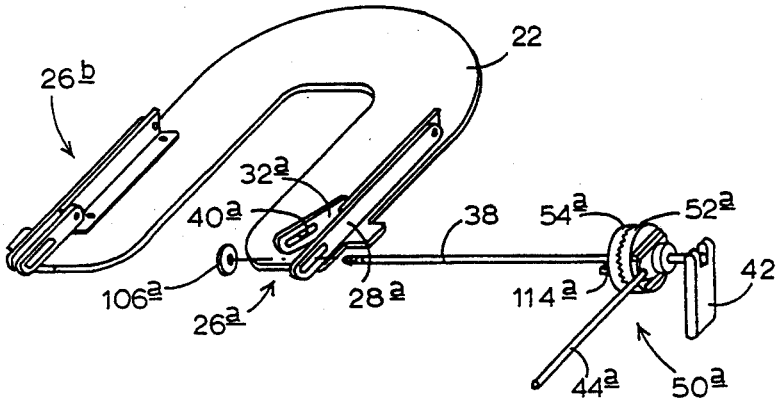
FIG. 7 is a partial exploded perspective view of a clamp structure, illustrating its assembly with a triangular support structure on the bottom side of a headrest base.

FIG. 7 shows the step of inserting rod 38 through apertures in the arms of triangular support structures 26*a* and 26*b* after assembly of clamp 50*a*. It can be noted in FIG. 7 that the apertures in both short arm 32*a* and long arm 28*a* of triangular support structure 26*a* have slots through which rod 38 passes. In a preferred embodiment, rod 38 is not allowed to move longitudinally relative to the slot of long arm 28*a* , regardless of whether the clamps are locked or unlocked. The mechanism for preventing such movement is described below. In contrast, slot 40*a* in short arm 32*a* is moveable relative to rod 38 when clamp 50*a* is in the release-position. Thus, the effective length of short arm 32*a* may be altered while the effective length of 28*a* remains fixed. However, it is also possible to produce a functioning headrest in accordance with the present invention, by allowing the effective length of both the short arm and long arm or a triangular support structure to be varied when the clamp is in the release-position. Further, it is also possible to make the effective length of the long arm adjustable while holding the effective length of the short arm constantly fixed. All that is necessary is that the effective length of at least one of the arms is adjustable when the clamp is in the release-position, and fixed when the clamp is in the lock-position.

Figure 8:
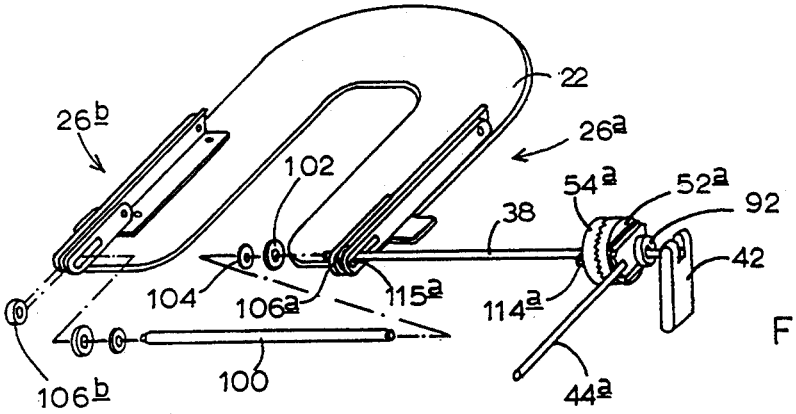
FIG. 8 is a partial exploded perspective view illustrating further assembly steps of the clamp structure shown in FIG. 7.

FIG. 8 illustrates further assembly steps of the clamp and horizontal rod elements relative to the triangular support structures. After passing rod 38 through the apertures in the arms of triangular support structure 26*a*, the rod passes through large plastic washer 102 and steel washer 104, then cover sleeve 100 followed by two more washers. It is advantageous for washer 102 as well as spacers 106*a* and 106*b*, which directly contact length-adjustable short arm 32*a*, to be made out of smooth plastic. This allows smooth movement of short arm 32*a* during the adjustment process, while also facilitating a strong friction engagement of short arm 32*a* when the clamp is in the lock-position. Rod 38 then passes through the apertures in the arms of triangular support structure 26*b*, then plastic spacer 106*b*.

Figure 9:
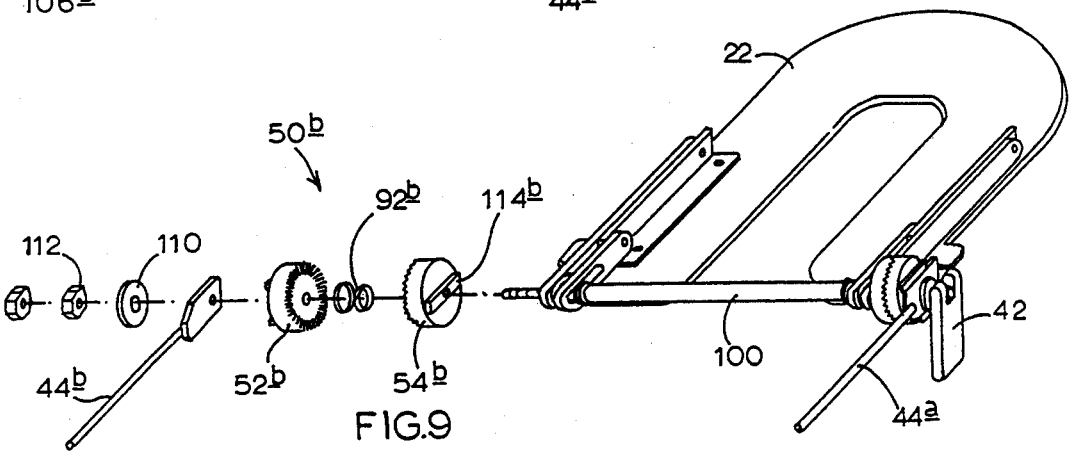
FIG. 9 is a partial exploded perspective view of the support arms and clamp structure, assembled in accordance with a preferred embodiment of the present invention.

As shown in FIG. 9, clamp 50*b* consisting of rotational disc 54*b*, spring 92*b*, stationary disc 52*b*, rod 44*b*, steel washer 110, and nuts 112 are attached in series to the end of rod 38 opposite from cam lever 42. The double nut arrangement at the end of rod 38 opposite from cam lever 42, allows the total clamping pressure to be adjusted by screwing the nuts along the rod, thus changing the distance between the nuts and the lever. The adjustment can be accomplished by rotating the lever around the axis defined by rod 38. The nuts should be adjusted to a point where the serrated discs are fully engaged when the lever is in the lock-position, and fully disengaged when the lever is in the release-position.

It can be seen in FIGS. 8 and 9 that rotating discs 54*a* and 54*b* each have a ridge-like protrusion 114*a* and 114*b*, respectively, which is dimensioned to fit into slots 115*a* and 115*b* (not shown) in the long arms 28*a* and 28*b* in each of the triangular support structures. Engagement of the rotating disc protrusions with their respective long arm slots, accomplishes both the purposes of, fixing the effective length of the long arms, and preventing the stationary discs from rotating relative to the triangular support structures.

Figure 10:
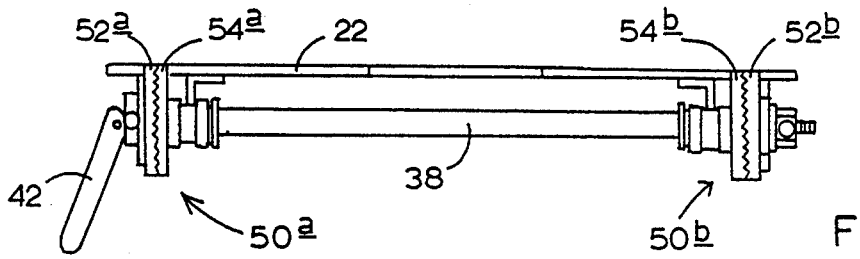
FIG. 10 is an end view of a headrest embodiment of the present invention, illustrating the clamp structures in their lock-positions.
Figure 11:
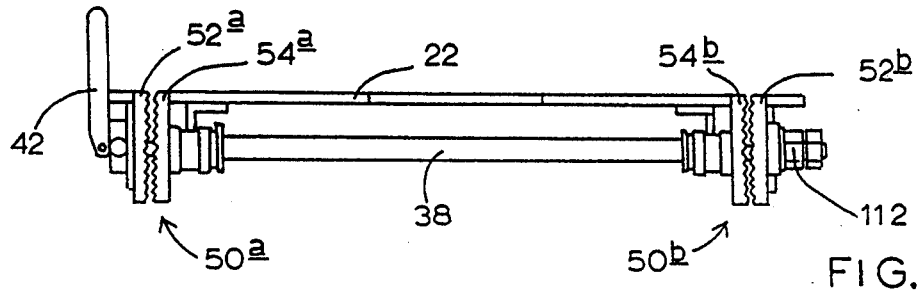
FIG. 11 is an end view of a headrest embodiment of the present invention illustrating the clamp structures in their release-positions.

FIGS. 10 and 11 illustrate concerted engagement and disengagement of both clamps. In FIG. 10, cam lever 42 is in the lock-position. Because of the cam shape of lever 42, when it is in the lock-position, the distance between the lever and the nuts at the opposite end of rod 38, is decreased to a point where the serrated faces of the rotating discs 54*a* and 54*b* are forced to engage the serrated faces of stationary discs 52*a* and 52*b*, respectfully. As shown in FIG. 11, when cam lever 42 is in the release-position, the shape of cam lever 42 allows the distance between lever 42 and nuts 112 on the opposite end of rod 38 to be maximized, thereby allowing the disc pairs to disengage their respective serrated faces. When the disc faces are disengaged, rotation between base plate 22 relative to posts 44*a* and 44*b*, and effective length adjustment of arms 32*a* and 32*b* are allowed.

Figure 12:
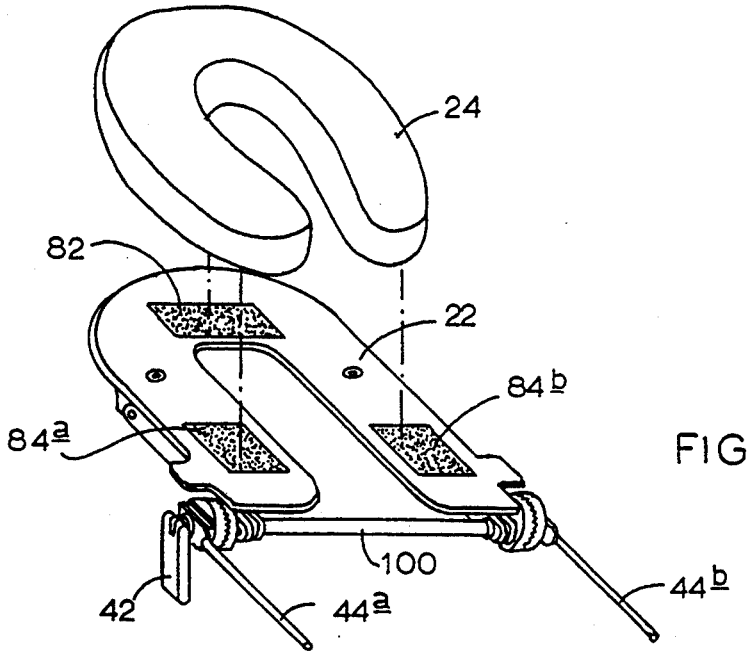
FIG. 12 is a perspective view of an adjustable headrest, illustrating attachment of a pad to a base.

FIG. 12 shows that the pad can be simply attached to the top side of base plate 22 via velcro patches 82, 84*a* and 84*b*.

Figure 13:
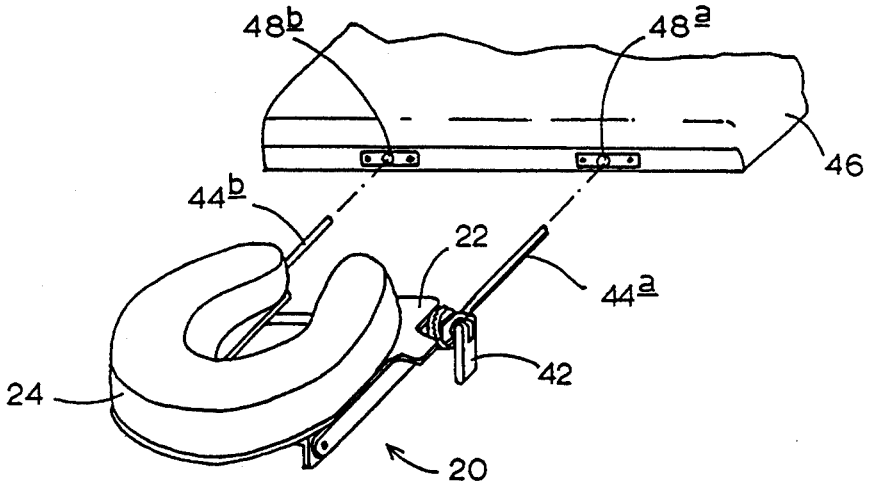
FIG. 13 is a perspective view of an adjustable headrest prepared for installation on a table.

FIG. 13 shows how headrest 20 is attached to table 46 by inserting posts 44*a* and 44*b* into respective holes 48*a* and 48*b* provided in table 46.

Although a detailed description of the preferred embodiment has been set forth above, it is apparent that many modifications are possible without departing from the general principals of the present invention as claimed below.

For example, in the preferred embodiment, a base plate is used to support the pad. However, the present invention clearly contemplates other designs which would not employ a "plate", but instead would use virtually any type of rigid structure, made of wood, metal, hard plastic, etc., which is capable of supporting a head as well as being fixedly orientated relative to proximal and distal junction structures. It is also apparent that, although the base plate illustrated and described above is symmetrical relative to its bisecting plane, such symmetry is not necessary and should not be read as a limitation of the claimed invention.

Another aspect of the invention which may be varied, is the orientation of the proximal and distal junctions relative to the base and its bisecting plane (Z in FIG. 2). In the preferred embodiment, the proximal and distal junctions, to which the long and short arms are pivotally attached, are practically co-planar with the base. However, it is apparent that the present invention may also be practiced with an adjustable headrest in which the junctions have been moved away from the plane which contains the base. It is also possible to alter the angle formed by the line connecting the junctions and the plane containing the base. It is also possible to substantially alter the location of the proximal and distal junctions relative to the bisecting plane. As described above, the proximal and distal junctions are connected by a line which is substantially parallel to the bisecting plane. However, it is possible to produce an adjustable headrest, according to the principles of the present invention, in which the proximal and distal junctions are separated along a direction or axis perpendicular to the bisecting plane, as long as the axis of rotation in each junction structure is substantially normal to the bisecting plane. In such a configuration, the concept of a "triangular support structure" is still present from a side perspective of the headrest.

It is also apparent that, although the described serrated-disc clamping assembly is preferred, many other types of clamps can be used without departing from the general scope and spirit of the invention as claimed.

I claim:

1. An adjustable headrest comprising:

a base structure having an open central region, a top side and a bottom side, wherein an imaginary longitudinal plane perpendicularly bisects the base structure into two lateral portions;

proximal and distal junction structures secured in a fixed orientation near and relative to the bottom side of the base structure;

a short arm having a first end and a second end, the proximal junction structure being pivotally connected to the short arm near its first end;

a long arm having a first end and a second end, the distal junction structure being pivotally connected to the long arm near its first end;

a rod, perpendicularly oriented relative to the longitudinal plane forming a common axis of rotation for both the short and long arms near their second ends;

said second triangular support structure is spaced apart and distinct from said first triangular support structure, wherein a first triangular support structure is defined, from a side view perspective, by the two arms and the portion of the base structure which extends between the two junction structures, each of the arms having an effective length relative to the triangular support structure, one arm's effective length being adjustable by sliding movement in a direction perpendicular to the rod;

a second triangular support structure in the same form as the first triangular support structure, said second triangular support structure is spaced apart and distinct from said first triangular support structure, wherein each lateral portion of the base structure has one of the triangular support structures attached to its bottom side; and a clamp associated with the rod, capable of alternately locking and releasing all pivotal orientation and effective length adjustment of the arms of both triangular support structures relative to the rod.

2. The headrest of claim 1 further comprising a pad fastenable to the top side of the base structure.

3. The headrest of claim 2 wherein the base structure is a substantially U-shaped plate.

4. The headrest of claim 2 wherein the pad has a central opening for receiving a person's face.

5. The headrest of claim 1 further comprising a longitudinal flange securely attached to the bottom side of the base structure, wherein the proximal and distal junction structures are located on the flange along a line substantially parallel to the plane of symmetry.

6. The headrest of claim 1 wherein the short arm has a longitudinal slot near its second end through which the rod passes, so that the effective length of the short arm can be varied by changing the position of the rod within the slot.

7. The headrest of claim 1 wherein the proximal and distal junction structures are located along a line substantially parallel to the longitudinal plane.

8. An adjustable headrest comprising:

a base structure having a top side and a bottom side, wherein an imaginary longitudinal plane perpendicularly bisects the base structure into two lateral portions;

proximal and distal junction structures secured in a fixed orientation near and relative to the bottom side of the base structure;

a short arm having a first end and a second end, the proximal junction structure being pivotally connected to the short arm near its first end;

a long arm having a first end and a second end, the distal junction structure being pivotally connected to the long arm near its first end;

a rod, perpendicularly oriented relative to the longitudinal plane forming a common axis of rotation for both the short and long arms near their second ends;

wherein a first triangular support structure is defined, from a side view perspective, by the two arms and the portion of the base structure which extends between the two junction structures, each of the arms having an effective length relative to the triangular support structure, one arm's effective length being adjustable by sliding movement in a direction perpendicular to the rod;

a second triangular support structure like the first triangular support structure, said second triangular support structure is spaced apart and distinct from said first triangular support structure, wherein each lateral portion of the base structure has one of the triangular support structures attached to its bottom side; and a clamp associated with the rod, capable of alternately locking and releasing all pivotal orientation and effective length adjustment of the arms relative to the rod.

9. The headrest of claim 8 further comprising a pair of posts for anchoring the headrest to a chair or table;

a pair of stationary discs, each of which is fixedly attached to one of the posts and has a serrated face around a hole through which the rod passes, so that when the posts are anchored to a chair or table, the orientation of the serrated face remains rotationally stationary irrespective of base structure movement;

a pair of rotating discs, each of which is fixedly attached to one of the triangular support structures, and having a serrated face juxtaposed with the serrated face of a corresponding stationary disc, and a central hole through which the rod passes; and a cam lever moveable between a lock-position and a release-position, so that when the cam lever is moved to the lock-position the serrated face of each stationary disc is forced to engage the serrated face of the corresponding rotating disc, thereby locking all movement of the triangular support structure relative to the rod and posts.

10. An adjustable headrest comprising:

a rigid base having an open central region, a bottom side and an imaginary longitudinal plane perpendicularly bisecting the base into two lateral portions;

two support assemblies are spaced apart and distinct from one another secured in a fixed orientation near and relative to each lateral portion of the base, each assembly taking the form of a triangular support structure with three sides and three corners, the triangular support structure being pivotable around an axis which is perpendicular to the longitudinal plane and passes through one of the corners, a first of the sides having a fixed orientation relative to the base, a second of the sides having an adjustable effective length;

a clamp capable of being manipulated to lock and unlock all pivotability and side-effective length adjustability of both triangular support structures simultaneously.

11. An open-faced headrest for massage, comprising:

a base having a central opening between first and second lateral side portions;

a transverse rod;

first and second arms extending from the rod to the first lateral side portion of the base, both arms being rotatable around the rod, at least one of the first and second arms being slidable relative to the rod;

third and fourth arms extending from the rod to the second lateral side portion of the base, both of the third and fourth arms being rotatable around the rod, at least one of the third and fourth arms being slidable relative to the rod, wherein the first and second arms are spaced apart and distinct from the third and fourth arms by a sleeve on the rod;

a pair of stationary discs, each of which has a serrated face around a hole through which the rod passes, so that when the stationary discs are anchored to a chair or table, the orientation of the serrated face remains rotationally stationary irrespective of movement of the base;

a pair of rotating discs, one of the rotating discs being connected to one of the first and second arms, the other rotating disc being connected to one of the third and fourth arms, each of the rotating discs having a serrated face juxtaposed with the serrated face of a corresponding stationary disc, and a central hole through which the rod passes; and a handle at one end of the rod, moveable between a lock-position and a release-position, so that when the handle is moved to the lock-position the serrated face of each stationary disc is forced to engage the serrated face of the corresponding rotating disc, and the sleeve is forcefully sandwiched between the second and third arms, thereby locking all rotational and sliding movement of the arms relative to the rod.

* * * * *